US011078925B2

(12) United States Patent
Sakaguchi et al.

(10) Patent No.: US 11,078,925 B2
(45) Date of Patent: Aug. 3, 2021

(54) VACUUM PUMP AND ROTATING CYLINDRICAL BODY INCLUDED IN VACUUM PUMP

(71) Applicant: Edwards Japan Limited, Chiba (JP)

(72) Inventors: Yoshiyuki Sakaguchi, Chiba (JP); Tooru Miwata, Chiba (JP); Nahoko Yoshihara, Chiba (JP)

(73) Assignee: Edwards Japan Limited, Chiba (JP)

( * ) Notice: Subject to any disclaimer, the term of this patent is extended or adjusted under 35 U.S.C. 154(b) by 92 days.

(21) Appl. No.: 16/327,154

(22) PCT Filed: Aug. 9, 2017

(86) PCT No.: PCT/JP2017/028865
§ 371 (c)(1),
(2) Date: Feb. 21, 2019

(87) PCT Pub. No.: WO2018/043072
PCT Pub. Date: Mar. 8, 2018

(65) Prior Publication Data

US 2019/0195238 A1 Jun. 27, 2019

(30) Foreign Application Priority Data

Aug. 30, 2016 (JP) ..... JP2016-168083

(51) Int. Cl.
*F04D 29/52* (2006.01)
*F04D 19/04* (2006.01)
(Continued)

(52) U.S. Cl.
CPC ..... *F04D 29/526* (2013.01); *F04D 3/00* (2013.01); *F04D 19/042* (2013.01);
(Continued)

(58) Field of Classification Search
CPC ..... F04D 19/04; F04D 19/042; F04D 19/046
(Continued)

(56) References Cited

U.S. PATENT DOCUMENTS 4,684,317 A 8/1987 Luijten et al.
4,929,151 A * 5/1990 Long ..... F04D 29/584 415/177

(Continued)

FOREIGN PATENT DOCUMENTS

JP S5286576 S 7/1977
JP H0227194 A 1/1990

(Continued)

OTHER PUBLICATIONS

PCT International Search Report dated Oct. 24, 2017 for corresponding PCT Application No. PCT/JP2017/028865.

(Continued)

*Primary Examiner* — Aaron R Eastman
(74) *Attorney, Agent, or Firm* — Theodore M. Magee; Westman, Champlin & Koehler, P.A.

(57) ABSTRACT

A vacuum pump reduces a stress without reducing the rotation speed of a rotating cylindrical body. In an outlet port-side lower portion of a rotor cylindrical portion included in the vacuum pump, a smaller diameter portion having an outer diameter smaller than that of an inlet port-side portion of the rotor cylindrical portion is provided. A lowermost end portion (outlet port-side end portion) of the rotor cylindrical portion is designed longer than a thread groove exhaust element to provide an extending portion. In the extending portion, a smaller diameter portion having an outer diameter smaller than that of the inlet port-side portion of the rotor cylindrical portion which is opposed to the thread groove exhaust element is provided.

14 Claims, 6 Drawing Sheets

(51) Int. Cl.
*F04D 29/32* (2006.01)
*F04D 3/00* (2006.01)
*F04D 29/40* (2006.01)

(52) U.S. Cl.
CPC ..... *F04D 19/044* (2013.01); *F04D 29/32* (2013.01); *F04D 29/403* (2013.01); *F05D 2250/292* (2013.01); *F05D 2250/52* (2013.01)

(58) Field of Classification Search
USPC ..... 415/90
See application file for complete search history.

(56) References Cited

U.S. PATENT DOCUMENTS

| | | | | |
|---|---|---|---|---|
| 5,154,572 | A | 10/1992 | Toyoshima et al. | |
| 2013/0243583 | A1* | 9/2013 | Kawanishi ..... | F04D 29/526 415/191 |

FOREIGN PATENT DOCUMENTS

| | | | |
|---|---|---|---|
| JP | H10246197 | A | 9/1998 |
| JP | 2000009087 | A | 1/2020 |
| WO | 2012077411 | A1 | 5/2014 |

OTHER PUBLICATIONS

PCT International Written Opinion dated Oct. 24, 2017 for corresponding PCT Application No. PCT/JP2017/028865.
Communication dated Jun. 19, 2020 for corresponding European application Serial No. 17846081.2.

* cited by examiner

VACUUM PUMP AND ROTATING CYLINDRICAL BODY INCLUDED IN VACUUM PUMP

CROSS-REFERENCE OF RELATED APPLICATION

This application is a Section 371 National Stage Application of International Application No. PCT/JP2017/028865, filed Aug. 9, 2017, which is incorporated by reference in its entirety and published as WO 2018/043072 A1 on Mar. 8, 2018 and which claims priority of Japanese Application No. 2016-168083, filed Aug. 30, 2016.

BACKGROUND

The present invention relates to a vacuum pump and to a rotating cylindrical body included in the vacuum pump.

In particular, the present invention relates to a vacuum pump which reduces a stress applied to a rotating cylindrical body and to the rotating cylindrical body included in the vacuum pump.

There is a vacuum pump for performing a vacuum exhaust process in a vacuum chamber disposed therein which includes a rotating body and a thread groove exhaust element (thread-groove exhaust mechanism/thread groove pump portion). The vacuum pump including the thread groove exhaust element has a configuration in which, under a rotor blade disposed in the rotating body, a rotating cylindrical body (rotor cylindrical portion) having no rotor blade is provided to compress a gas in the thread groove exhaust element outside the rotor blade.

In a general vacuum pump including such a vacuum pump in which a rotor cylindrical portion is provided, a centrifugal force may cause a stress in a radially inner part of the rotor cylindrical portion, and the stress may exceed a design reference value.

FIG. 6 is a view for illustrating a conventional vacuum pump 1000.

As shown in FIG. 6, in the conventional vacuum pump 1000, a rotor cylindrical portion 1001 is disposed to be opposed to a thread groove exhaust element 20 via a gap (clearance) in an axial direction. When a stress is generated in the rotor cylindrical portion 1001, a creep phenomenon occurs in which the rotor cylindrical portion 1001 that has moved at a high temperature for a long period is gradually deformed/expanded.

In terms of maintenance cost, a creep lifetime which is a period until the clearance between the thread groove exhaust element 20 and the rotor cylindrical portion 1001 is reduced in size by a prescribed amount due to the creep phenomenon is preferably maximized.

Japanese Patent Application Publication No. H10-246197 describes a technique in which, to prevent a local stress or a temperature increase from occurring in a rotor blade or a portion supporting the rotor blade even when the rotor blade is rotated at a high speed, the rotor blade is designed such that an outer diameter thereof near an outlet port is different from an outer diameter thereof near an inlet port.

The discussion above is merely provided for general background information and is not intended to be used as an aid in determining the scope of the claimed subject matter. The claimed subject matter is not limited to implementations that solve any or all disadvantages noted in the background.

SUMMARY OF THE INVENTION

Besides adopting such a configuration as adopted in Japanese Patent Application Publication No. H10-246197 described above, the rotation speed of the rotating body (rotor blade/rotating cylindrical body) is reduced to reduce the stress.

However, when the rotation speed of the rotating body is reduced, exhaust performance is deteriorated.

An object of the present invention is to provide a vacuum pump capable of reducing a stress without reducing the rotation speed of a rotating cylindrical body (rotating body), and the rotating cylindrical body included in the pump.

The present invention in a first aspect provides a vacuum pump including a housing in which an inlet port and an outlet port are formed, a thread-groove exhaust mechanism which is fixed to the housing and has a thread groove, a rotating shaft which is rotatably supported and is enclosed in the housing, and a rotating cylindrical body which is disposed on the rotating shaft and includes an opposed portion opposed to the thread-groove exhaust mechanism via a gap and an extending portion extending downstream of the thread-groove exhaust mechanism, the extending portion including a smaller diameter portion having an outer diameter smaller than an outer diameter of the opposed portion.

The present invention in a second aspect provides the vacuum pump in the first aspect in which the smaller diameter portion includes, on a radially outer part thereof, a bottom surface perpendicular to an axial direction of the rotating shaft, and an angle formed between the bottom surface and a radially outer surface of the smaller diameter portion is a right angle.

The present invention in a third aspect provides the vacuum pump in the second aspect in which a position of the bottom surface of the smaller diameter portion coincides with a position of a starting point of the extending portion.

The present invention in a fourth aspect provides the vacuum pump in the first or second aspect in which the smaller-diameter portion is formed by providing a gradient in at least a portion of the extending portion located between a starting point and a terminal point thereof.

The present invention in a fifth aspect provides the vacuum pump in the fourth aspect in which a starting point of the gradient of the smaller diameter portion coincides with the starting point of the extending portion.

The present invention in a sixth aspect provides a rotating cylindrical body included in the vacuum pump according to any one of the first to fifth aspects.

According to the present invention, it is possible to reduce a stress in a portion of the rotating cylindrical body which affects a creep lifetime without reducing the rotation speed. As a result, exhaust performance can be retained or improved compared to that in a configuration designed to reduce a stress by reducing the rotation speed.

The Summary is provided to introduce a selection of concepts in a simplified form that are further described in the Detail Description. This summary is not intended to identify key features or essential features of the claimed subject matter, nor is it intended to be used as an aid in determining the scope of the claimed subject matter.

DESCRIPTION OF THE PREFERRED EMBODIMENTS

(i) Outline of Embodiment

In a vacuum pump according to an embodiment of the present invention, in an outlet port-side lower portion of a rotor cylindrical portion (rotating cylindrical body) included in the vacuum pump, a smaller diameter portion (tapered/chamfered portion) having an outer diameter smaller than that of an inlet port-side portion of the rotor cylindrical portion is provided.

More specifically, a lowermost end portion (outlet port-side end portion) of the rotor cylindrical portion is designed longer than a thread groove exhaust element to provide an extending portion. In the extending portion of the rotor cylindrical portion, the smaller diameter portion having the outer diameter smaller than that of the inlet port-side portion (opposed portion) of the rotor cylindrical portion which is opposed to the thread groove exhaust element is provided.

In the rotor cylindrical portion, a stress generated in a radially inner part during rotation thereof is smaller as an outer diameter thereof is smaller. Accordingly, a configuration having the smaller diameter portion described above can reduce a stress generated in the radially inner part of the rotor cylindrical portion without reducing the rotation speed of a rotating body (such as the rotor cylindrical portion).

(ii) Details of Embodiment

The following will describe the preferred embodiment of the present invention in detail with reference to FIGS. 1 to 5.

Configuration of Vacuum Pump 1

Figure 1:
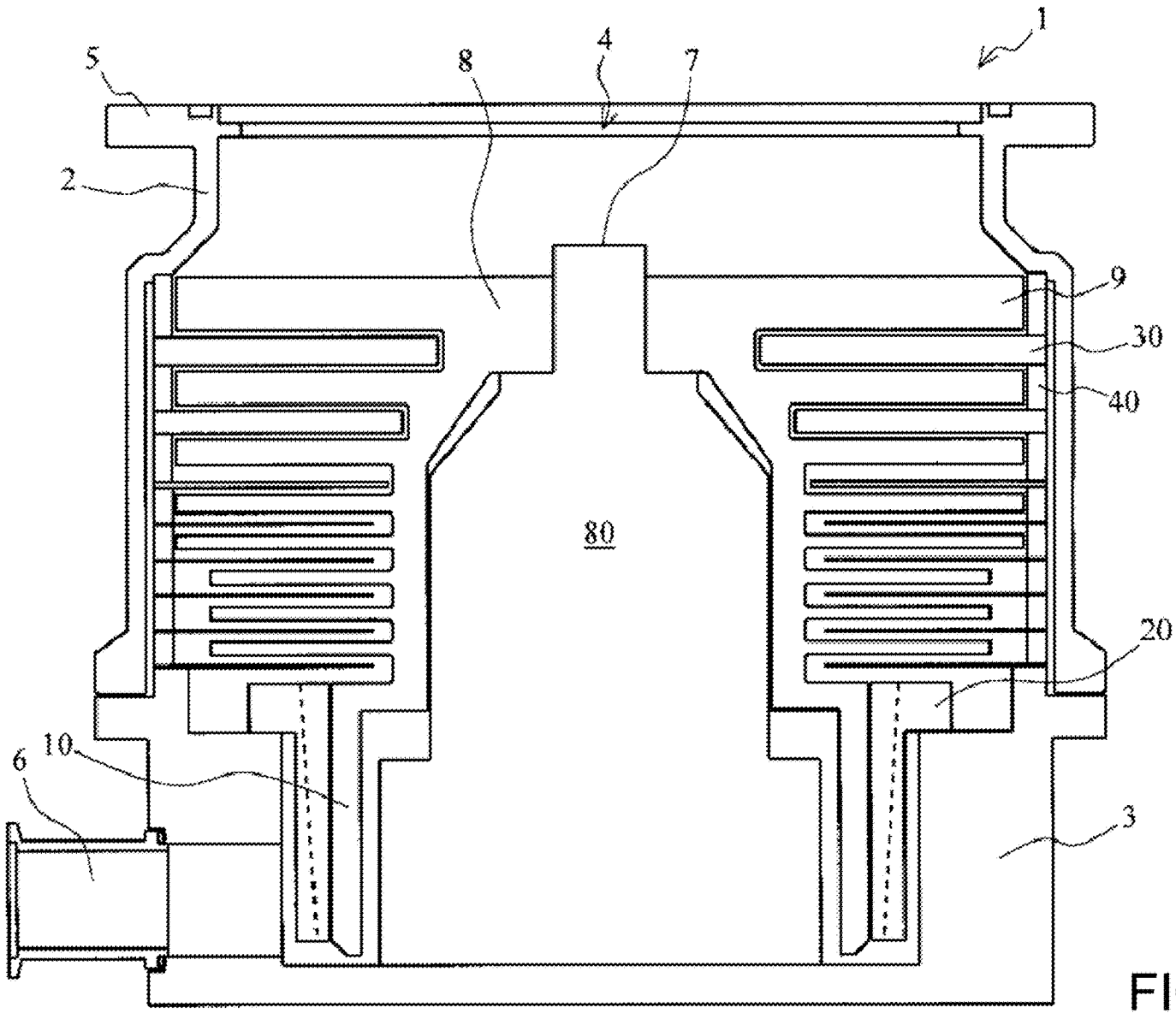
FIG. 1 is a view showing an example of a schematic configuration of a vacuum pump according to an embodiment of the present invention.

FIG. 1 is a view showing an example of a schematic configuration of a vacuum pump 1 according to the first embodiment of the present invention, which shows a cross-sectional view of the vacuum pump 1 in an axis direction thereof.

Note that, in the embodiment of the present invention, for the sake of convenience, a description will be given on the assumption that a diametrical direction of a rotor blade is a "diameter (diametrical/radial) direction" and a direction perpendicular to the diametrical direction of the rotor blade is the "axis direction (or axial direction)".

A casing (outer cylinder) 2 forming a housing of the vacuum pump 1 has a generally cylindrical shape and is included in a housing of the vacuum pump 1 in conjunction with a base 3 provided in a lower portion (on the side of an outlet port 6) of the casing 2. In the housing, a gas transfer mechanism as a structure which causes the vacuum pump 1 to perform an exhausting function is contained.

In the present embodiment, the gas transfer mechanism includes a rotatably supported rotating body (such as rotor blades 9/rotor cylindrical portion 10) and a stator portion (such as stator blade 30/thread groove exhaust element 20) fixed to the housing.

In addition, although not shown in the figure, outside the housing of the vacuum pump 1, a control device which controls an operation of the vacuum pump 1 is connected to the vacuum pump 1 via a dedicated line.

In an end portion of the casing 2, an inlet port 4 for introducing a gas into the vacuum pump 1 is formed. Around an inlet port 4-side end surface of the casing 2, a radially outwardly protruding flange portion 5 is formed.

In the base 3, the outlet port 6 for exhausting the gas from the vacuum pump 1 is formed.

The rotating body includes a shaft 7 as a rotating shaft, a rotor 8 disposed on the shaft 7, the plurality of rotor blades 9 provided in the rotor 8, and the rotor cylindrical portion (skirt portion) 10 provided on the outlet port 6 side.

Each of the rotor blades 9 is formed of a disc member in the form of a disc extending radially and perpendicularly to an axis line of the shaft 7.

The rotor cylindrical portion 10 is formed of a cylindrical member having a cylindrical shape coaxial to a rotation axis line of the rotor 8. In the present embodiment, a smaller diameter portion is provided in the rotor cylindrical portion 10. Note that the smaller diameter portion will be described later.

At about a middle of the shaft 7 in the axis direction, a motor portion for rotating the shaft 7 at a high speed is provided and enclosed in a stator column 80.

In the stator column 80, a radial magnetic bearing device for supporting the shaft 7 in a radial direction in non-contact relation is also provided to be closer to the inlet port 4 and the outlet port 6 than the motor portion of the shaft 7. At a lower end of the shaft 7, an axial magnetic bearing device for supporting the shaft 7 in the axis direction (axial direction) in non-contact relation is provided.

On an inner peripheral side of the housing (casing 2), a stator portion is formed. The stator portion includes stator blades 30 and blades each inclined at a predetermined angle from a plane perpendicular to the axis line of the shaft 7 and extending from an inner peripheral surface of the casing 2 toward the shaft 7. The stator blades 30 are spaced apart from each other by stator blade spacers 40 each having a cylindrical shape and are fixed thereby.

Note that the rotor blades 9 and the stator blades 30 are alternately disposed and formed in a plurality of pairs in the axis direction. To provide exhaust performance required of the vacuum pump 1, an arbitrary number of rotor components and an arbitrary number of stator components can be provided as necessary.

In the vacuum pump 1 according to the present embodiment, a thread groove exhaust element 20 (thread-groove exhaust mechanism) is disposed on the outlet port 6 side.

In a surface of the thread groove exhaust element 20 opposed to the rotor cylindrical portion 10, a thread groove (helical groove) is formed.

The surface (i.e., inner peripheral surface parallel with the axis line of the vacuum pump 1) of the thread groove exhaust element 20 opposed to the rotor cylindrical portion 10 faces an outer peripheral surface of the rotor cylindrical portion 10 with a predetermined clearance being interposed therebetween. The thread groove exhaust element 20 is configured such that, when the rotor cylindrical portion 10 rotates at a high speed, a gas compressed by the vacuum pump 1 is transmitted toward the outlet port 6, while being guided by the tread groove with the rotation of the rotor cylindrical portion 10. In other words, the thread groove serves as a flow path which transports the gas.

Thus, the surface of the thread groove exhaust element 20 opposed to the rotor cylindrical portion 10 and the rotor cylindrical portion 10 are opposed to each other with the predetermined clearance being interposed therebetween to form a gas transfer mechanism which transfers the gas using the thread groove formed in the inner peripheral surface of the thread groove exhaust element 20 extending in the axis direction.

Note that, to reduce a force which causes the gas to flow back toward the inlet port 4, the clearance is preferably minimized in size.

A direction of the helical groove formed in the thread groove exhaust element 20 corresponds to a direction extending toward the outlet port 6 when the gas is transported in a direction of rotation of the rotor 8 in the helical groove.

The helical groove is designed such that a depth thereof decreases with approach to the outlet port 6 and that the gas transported in the helical groove is more tightly compressed with approach to the outlet port 6.

The configuration described above allows the vacuum pump 1 to perform a vacuum exhaust process in a vacuum chamber (not shown) disposed in the vacuum pump 1.

Configuration of Rotor Cylindrical Portion 10

A detailed description will be given of the rotor cylindrical portion 10 described above using FIG. 2 and FIGS. 3A to 3C.

Figure 2:
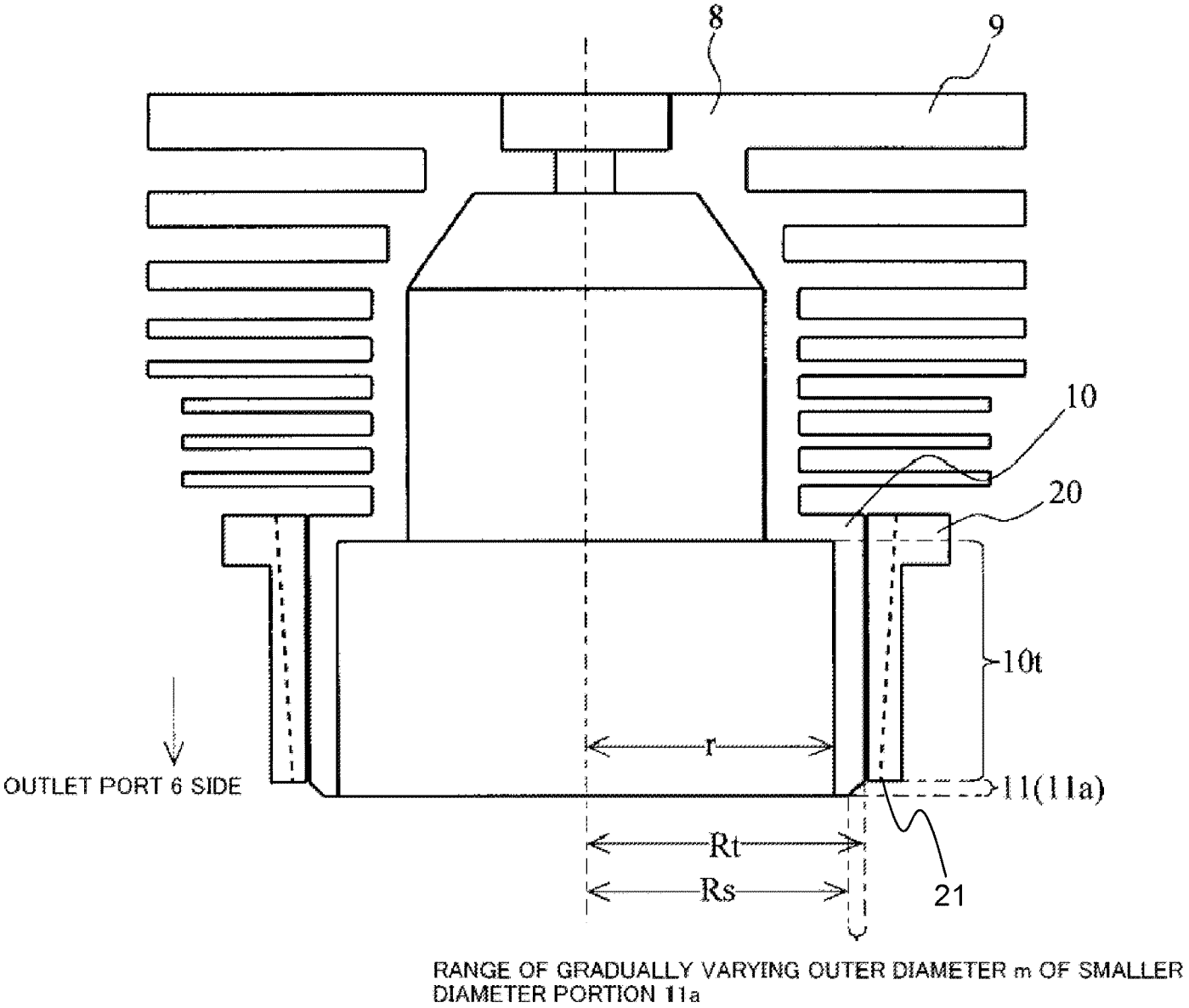
FIG. 2 is a view for illustrating a rotor cylindrical portion according to the embodiment of the present invention.

FIG. 2 is a view for illustrating an opposed portion 10*t*, an extending portion 11, and a smaller diameter portion 11*a* in the rotor cylindrical portion 10.

Figure 3C:
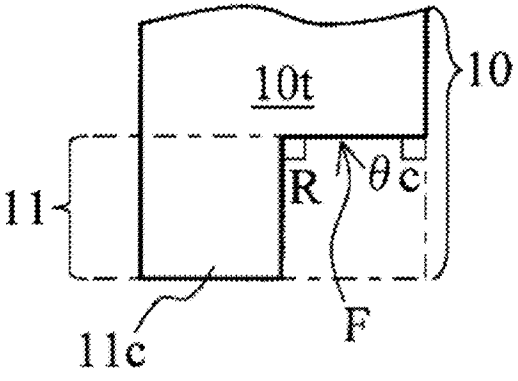
FIGS. 3A, 3B, and 3C are enlarged views for illustrating the rotor cylindrical portion according to the embodiment of the present invention.
Figure 3B:
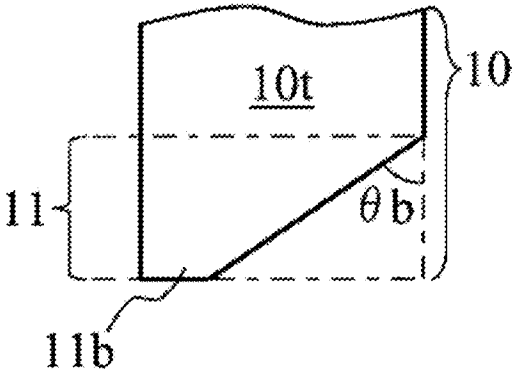
Figure 3A:
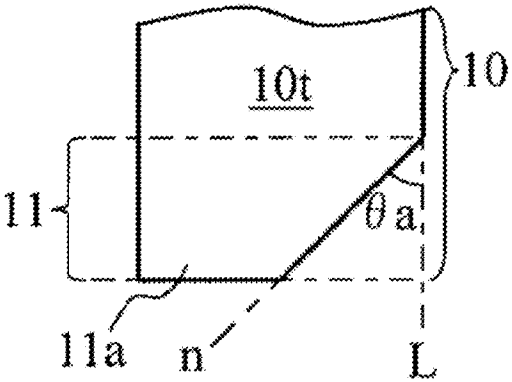

FIGS. 3A, 3B, and 3C are enlarged views of the opposed portion 10*t* and the extending portion 11 in the rotor cylindrical portion 10.

As shown in FIGS. 2 and 3A, the rotor cylindrical portion 10 has the opposed portion 10*t* opposed to the thread groove exhaust element 20 in the axis direction with a predetermined gap being interposed therebetween, the extending portion 11 extending to be closer to the outlet port 6 than a bottom surface 21 of the thread groove exhaust element 20, and the smaller diameter portion 11*a*.

In the description given in the present embodiment, it is assumed that r represents an inner diameter of the opposed portion 10*t* of the rotor cylindrical portion 10 and Rt represents an outer diameter thereof. Also, in the description given in the present embodiment, it is assumed that Rs represents an outer diameter of a lowermost end portion (the outlet port 6 side) of the smaller diameter portion 11*a* and *m* represents a gradually varying outer diameter of the smaller diameter portion 11*a*. Note that the present embodiment uses the term "gradually varying outer diameter" to mean "outer diameter which gradually varies".

The rotor cylindrical portion 10 included in the vacuum pump 1 according to the present embodiment has the extending portion 11 extending to be closer to the outlet port 6 than the thread groove exhaust element 20. In the extending portion 11, the smaller diameter portion 11*a* having the gradually varying outer diameter m ($r<m<Rt$) smaller than the outer diameter Rt of the portion (opposed portion 10*t*) of the rotor cylindrical portion 10 which is other than the extending portion 11 is formed. The gradually varying outer diameter m has a value decreasing with distance from the inlet port 4 toward the outlet port 6.

In other words, the rotor cylindrical portion 10 according to the present embodiment has a portion (smaller diameter portion 11*a*) having a gradient at a predetermined angle θa (FIG. 3A) in a radially outer part of the extending portion 11. The gradient can be configured by, e.g., designing the extending portion 11 such that the radially outer part thereof has a tapered shape or by chamfering the radially outer part of the extending portion 11.

Note that, in the present embodiment, the predetermined angle θa indicates an angle formed between an extension line L of a radially outer surface of the opposed portion 10*t* of the rotor cylindrical portion 10 and an extension line n of the gradually varying outer diameter m.

In the present embodiment, the rotor cylindrical portion 10 is configured such that a starting point (point of origin) of the extending portion 11 coincides with a starting point of the smaller diameter portion 11*a*, but the configuration of the rotor cylindrical portion 10 is not limited thereto. Specifically, the rotor cylindrical portion 10 may also be configured such that the extending portion 11 extending from the opposed portion 10*t* has an inlet port 4-side portion having the outer diameter Rt equal to the outer diameter of the opposed portion 10*t*, and the smaller diameter portion 11*a* having the gradually varying outer diameter m and decreasing in diameter is provided continuously to the extending portion 11. In other words, the rotor cylindrical portion 10 may be configured appropriately such that the smaller diameter portion 11*a* is formed at least in a portion of the extending portion 11 (see a configuration of a rotor cylindrical portion 100 in FIG. 4 described later).

Also, in the present embodiment, the rotor cylindrical portion 10 is configured such that the outer diameter Rs of a lowermost end portion (the outlet port 6 side) of the extending portion 11 coincides with a value of the gradually varying outer diameter m of the lowermost end portion (the outlet port 6 side) of the smaller diameter portion 11*a*. However, the configuration of the rotor cylindrical portion 10 is not limited thereto. Specifically, the rotor cylindrical portion 10 may also be configured such that the value of the gradually varying outer diameter m of the lowermost end portion of the smaller diameter portion 11*a* coincides with a value of an inner diameter r of the opposed portion 10*t*.

FIGS. 3B and 3C are views for illustrating modifications of the smaller diameter portion 11*a* (FIG. 3A).

FIG. 3B shows a smaller diameter portion 11*b* according to a first modification, while FIG. 3C shows a smaller diameter portion 11*c* according to a second modification.

As shown in FIG. 3B, the smaller diameter portion may also have a configuration similar to that of the smaller diameter portion 11*b* having an angle θb larger than the predetermined angle (gradient) θa of the smaller diameter portion 11*a* described above.

Alternatively, as shown in FIG. 3C, the smaller diameter portion may also have a configuration similar to that of the smaller diameter portion 11*c* in which the whole smaller diameter portion has the same outer diameter, not a configuration having the gradually varying outer diameter m as the outer diameter.

Specifically, the smaller diameter portion 11*c* is configured to have, on the inlet port 4 side, a surface F (bottom surface) perpendicular to an axial direction of the vacuum pump 1 such that an angle formed between the surface F and a radially outer side surface of the smaller diameter portion 11*c* is a right angle (R). In this case, the predetermined angle θc described above satisfies θc=90 degrees.

Note that, in FIG. 3C, the smaller diameter portion 11*c* is configured such that the surface F formed in the smaller diameter portion 11*c* on the inlet port 4 side is at a position coincident with a position of the starting point of the extending portion 11, but the configuration of the smaller diameter portion 11*c* is not limited thereto. The smaller diameter portion 11*c* may also be configured such that the surface F formed in the smaller diameter portion 11*c* is at a position lower by about several millimeters than the position of the starting point of the extending portion 11 toward the outlet port 6. In other words, the smaller diameter portion 11*c* may be configured appropriately to be formed in at least a portion of the extending portion 11.

Figure 4:
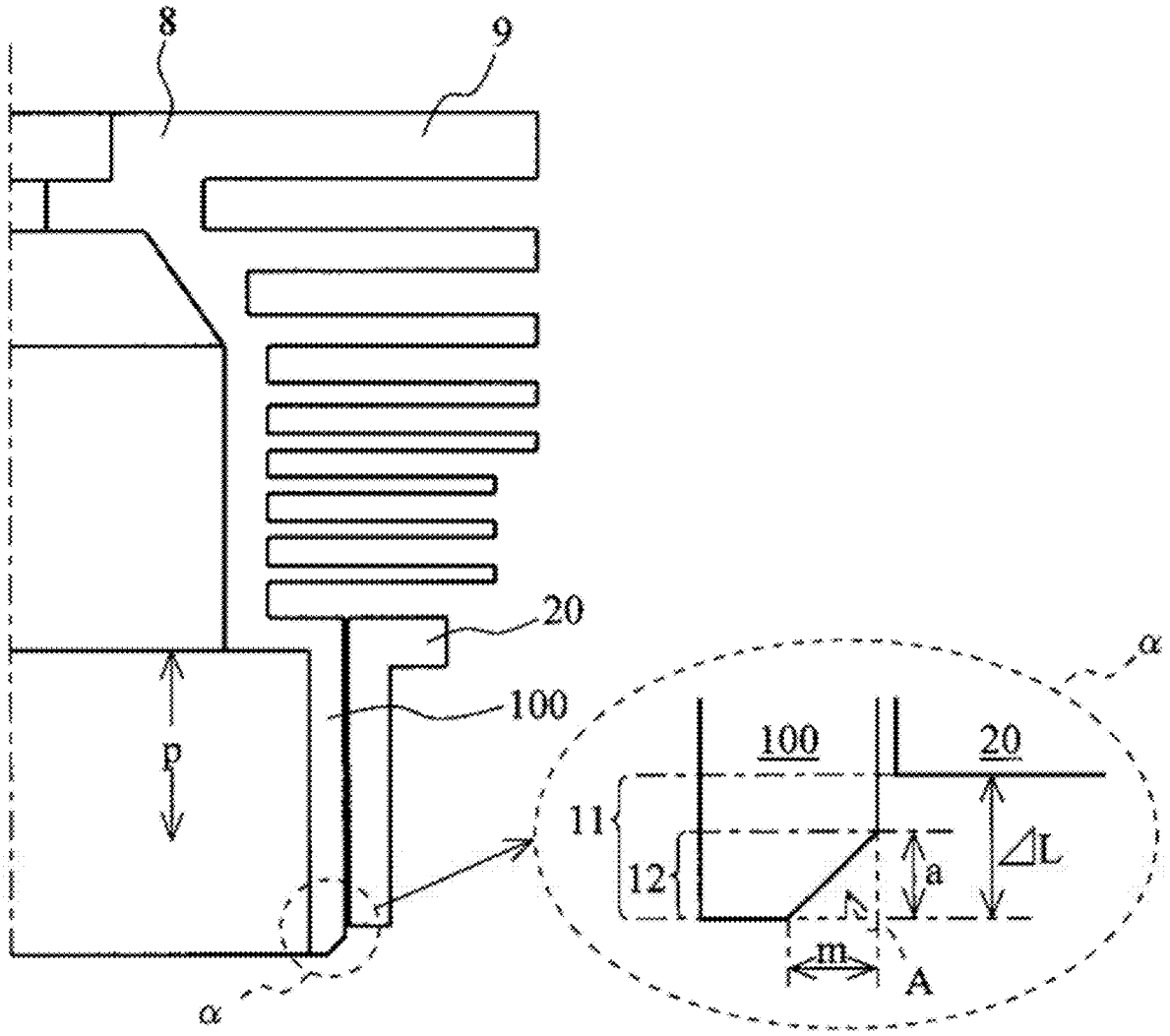
FIG. 4 is a view for illustrating a stress reducing effect of the vacuum pump according to the embodiment of the present invention.
Figure 5:
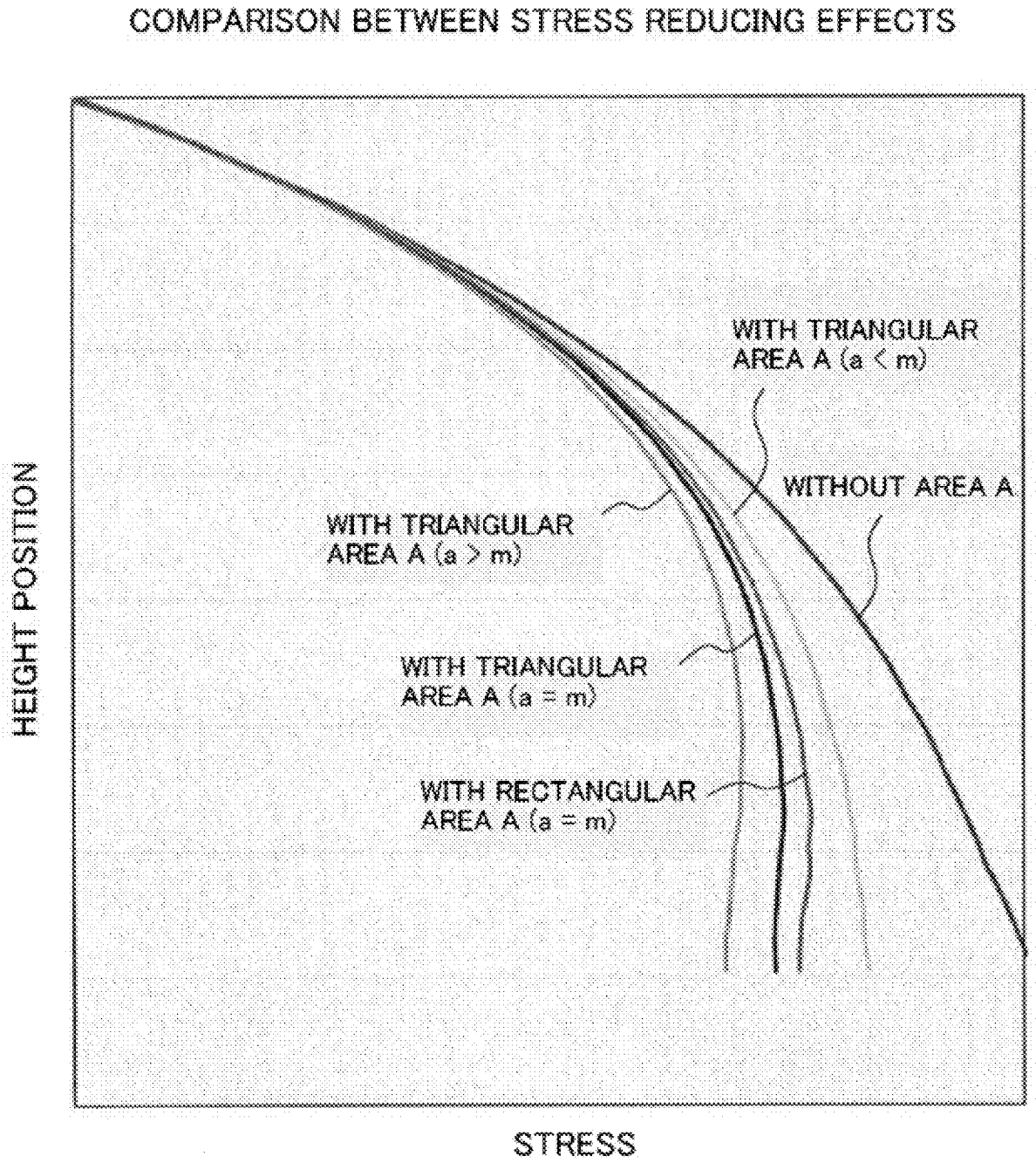
FIG. 5 is a view for illustrating the stress reducing effect of the vacuum pump according to the embodiment of the present invention.
Figure 6:
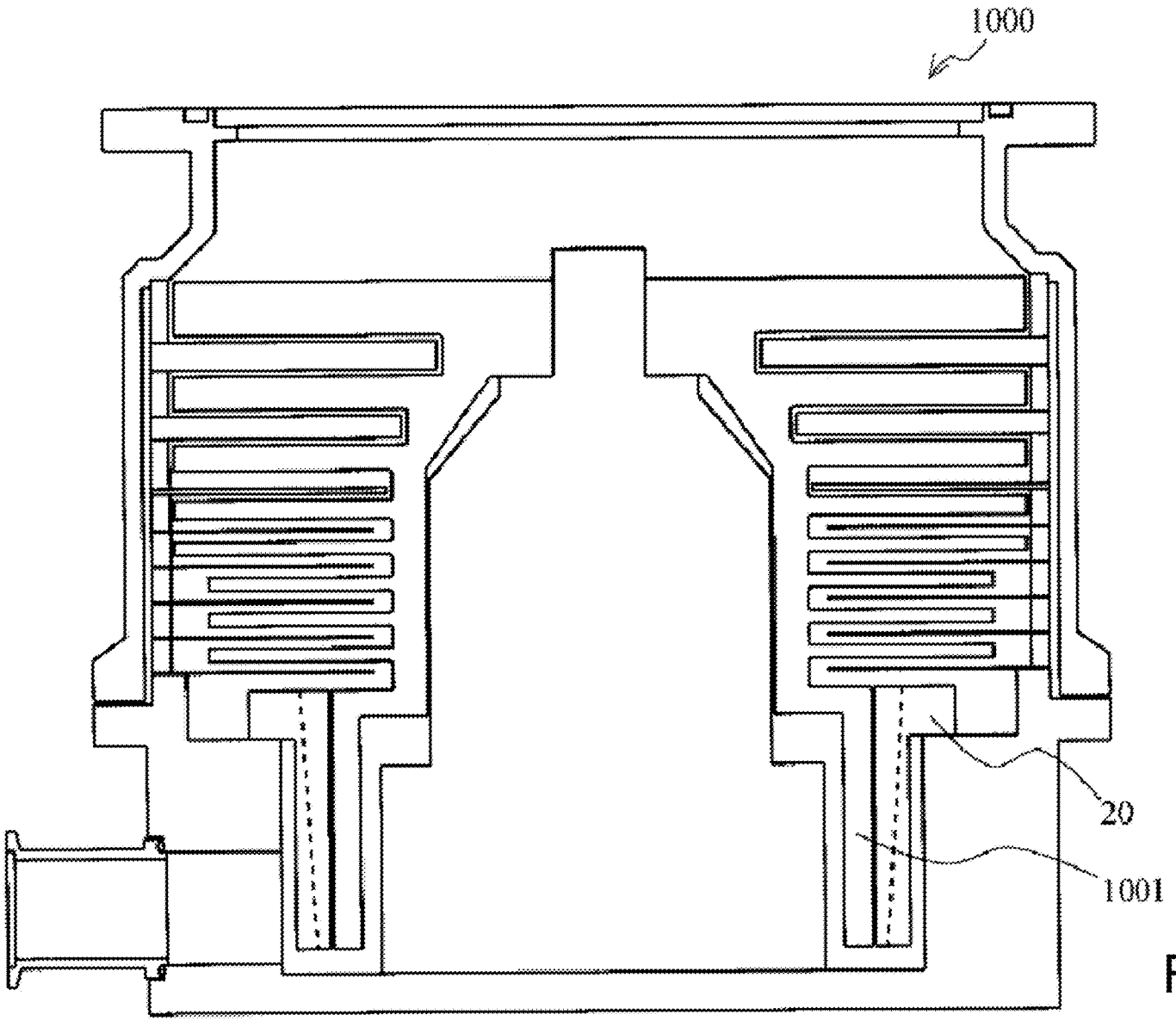
FIG. 6 is a view for illustrating a related art technique.

FIGS. 4 and 5 are views for illustrating a stress reducing effect of the vacuum pump 1 according to the present embodiment.

FIG. 4 shows a rotor cylindrical portion 100 including a smaller diameter portion 12 having a starting point different from the starting point of the extending portion 11 together with an enlarged cross-sectional view of a portion enclosed by a dotted-line a.

In FIG. 4, ΔL represents an axial length of the extending portion 11 in the rotor cylindrical portion 100, a length a represents an axial length of the smaller diameter portion 12 therein, and an area A represents a cross-sectional area of a portion cut away to form the smaller diameter portion 12 (cut-away area of a right-angled triangle defined by a solid diagonal line and two dotted lines).

FIG. 5 is a table comparing stress reducing effects, in which an ordinate axis represents a length (p) of a radially inner part of the rotor cylindrical portion 100 from the inlet port 4 side thereof and an abscissa axis represents a stress value (analytical value obtained during simulation) in the radially inner part of the rotor cylindrical portion 100 of the vacuum pump 1 including the rotor cylindrical portion 100.

As shown in FIG. 5, it can be seen from the analytical values that a stress generated in a radially inner part of the smaller diameter portion 12 is smaller in a structure in which the cut-away area A (triangular or rectangular cut-away portion) is provided than in a structure "WITHOUT AREA A" in which the cut-away area A is not provided (i.e., neither the extending portion 11 nor the smaller diameter portion 12 is provided).

It can also be seen from the result of analysis shown in FIG. 5 that, when the cut-away areas A have the same value, a configuration which satisfies "a>m" can most significantly reduce the stress.

Accordingly, unless particularly restricted, the axial length ΔL of the extending portion 11 in the rotor cylindrical portion 100 need not be designed to be larger than the axial length a of the smaller diameter portion 12. In other words, the extending portion 11 and the smaller diameter portion 12 need not necessarily be configured to satisfy ΔL>a.

Thus, it can be seen that, using the structures of the extending portion 11 and the smaller diameter portion 12, the vacuum pump 1 including the rotor cylindrical portion 100 reduces the stress generated in the radially inner part of the rotor cylindrical portion 100.

Note that, in FIGS. 4 and 5, the rotor cylindrical portion 100 is used by way of example, but the same results can be obtained even when the rotor cylindrical portion 10 is used.

Note that, in the configuration adopted in the present embodiment, the gradient of the smaller diameter portion 12 is formed of a linear shape in a cross section, but the shape of the gradient is not limited thereto. For example, although not shown in the figure, a configuration may also be adopted in which the gradient of the smaller diameter portion 12 is formed of a curved shape in a cross portion.

By adopting the configurations described above, the present embodiment can reduce a stress imposed on the radially inner part of each of the smaller diameter portions (11*a*, 11*b*, 11*c*, and 12) of the rotor cylindrical portion 10 (100) which affects a creep lifetime without reducing the rotation speed of the rotating body including the rotor cylindrical portion 10 (100).

In addition, since it is possible to prevent a creep phenomenon without reducing the rotation speed, it is possible to prevent deterioration of the exhaust performance of the vacuum pump 1 due to a reduction in the rotation speed.

Alternatively, since this configuration can increase the rotation speed of a rotor portion including the rotor cylindrical portion 10 (100), it is possible to improve the exhaust performance of the vacuum pump 1.

Note that the embodiment of the present invention and the individual modifications thereof may also be configured to be combined with each other as necessary.

Various modifications can be made to the present invention without departing from the spirit of the present invention. It should be clearly understood that the present invention is intended to encompass such modifications.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are described as example forms of implementing the claims.

What is claimed is:

1. A vacuum pump comprising:

a housing in which an inlet port and an outlet port are formed;

a thread-groove exhaust mechanism which is fixed to the housing and has a thread groove;

a rotating shaft which is rotatably supported and is enclosed in the housing; and a rotating cylindrical body which is disposed on the rotating shaft and includes an opposed portion opposed to the thread-groove exhaust mechanism via a gap and an extending portion extending downstream of a bottom surface of the thread-groove exhaust mechanism, the extending portion including a smaller-diameter portion having an outer diameter smaller than an outer diameter of the opposed portion, wherein an amount of diameter reduction in which an outer diameter of the extending portion is reduced is larger than an amount of diameter expansion in which an inner diameter of the extending portion is expanded.

2. The vacuum pump according to claim 1, wherein the extending portion includes a radially outer side surface of the smaller-diameter portion that terminates at a surface perpendicular to an axial direction of the rotating shaft, and an angle formed between the surface perpendicular to the axial direction and the radially outer side surface of the smaller-diameter portion is a right angle.

3. The vacuum pump according to claim 2, wherein a position of the surface perpendicular to the axial direction coincides with a position of a starting point of the extending portion.

4. A rotating cylindrical body included in the vacuum pump according to claim 3.

5. The vacuum pump according to claim 2, wherein the smaller-diameter portion is formed by providing a gradient in at least a portion of the extending portion located between a starting point and a terminal point thereof.

6. The vacuum pump according to claim 5, wherein a starting point of the gradient of the smaller-diameter portion coincides with the starting point of the extending portion.

7. A rotating cylindrical body included in the vacuum pump according to claim 6.

8. A rotating cylindrical body included in the vacuum pump according to claim 5.

9. A rotating cylindrical body included in the vacuum pump according to claim 2.

10. The vacuum pump according to claim 1, wherein the smaller-diameter portion is formed by providing a gradient in at least a portion of the extending portion located between a starting point and a terminal point thereof.

11. The vacuum pump according to claim 10, wherein a starting point of the gradient of the smaller-diameter portion coincides with the starting point of the extending portion.

12. A rotating cylindrical body included in the vacuum pump according to claim 11.

13. A rotating cylindrical body included in the vacuum pump according to claim 10.

14. A rotating cylindrical body included in the vacuum pump according to claim 1.

* * * * *